United States Patent [19]

Hottinger et al.

[11] 4,092,900

[45] June 6, 1978

[54] WEAPON SYSTEM EQUIPPED WITH RELOADING CONTAINER

[75] Inventors: Conrad Hottinger; Bruno Ruppen, both of Zurich; Kurt Schaffner, Worblaufen, all of Switzerland

[73] Assignee: Werkzeugmaschinenfabrik Oerlikon-Bührle AG, Zürich, Switzerland

[21] Appl. No.: 778,681

[22] Filed: Mar. 17, 1977

[30] Foreign Application Priority Data

Mar. 30, 1976 Switzerland ..... 3948/76

[51] Int. Cl.[2] ..... F41F 9/06

[52] U.S. Cl. ..... 89/33 B; 89/34; 89/45

[58] Field of Search ..... 89/1.801, 1.804, 33 A, 89/33 B, 34, 45, 46, 47

[56] References Cited

U.S. PATENT DOCUMENTS 2,933,981 4/1960 Anderson et al. ..... 89/45

*Primary Examiner*—Stephen C. Bentley

*Attorney, Agent, or Firm*—Werner W. Kleeman

[57] ABSTRACT

A weapon system containing a gun mount upon which there is mounted to be pivotable about an elevation alignment axis an automatic firing weapon or gun containing an ammunition container or magazine. A reloading container having an ammunition outlet opening is arranged at the gun mount. There is provided a conveyor device, by means of which sets of cartridges located in the reloading container can be brought to the outlet opening from which location these cartridges can be refilled into the ammunition container. The reloading container is displaceably arranged at the gun mount and its outlet opening can be brought into alignment with an inlet opening of the ammunition container which has been pivoted into an ammunition loading position. The conveyor device comprises transport elements which can be moved together with the sets of cartridges out of the reloading container into the ammunition container.

5 Claims, 7 Drawing Figures

WEAPON SYSTEM EQUIPPED WITH RELOADING CONTAINER

BACKGROUND OF THE INVENTION

The present invention relates to a new and improved construction of a weapon system or firearm which is of the type comprising a gun mount at which there is arranged for pivotable movement about an elevation aligning or alignment axis an automatic gun equipped with an ammunition container or magazine, a reloading container mounted at the gun mount which has an ammunition outlet opening and provided with a conveyor device by means of which sets of cartridges located in the reloading container can be brought to the ammunition outlet opening, from where the ammunition can be refilled into the ammunition container or magazine.

According to a heretofore known weapon or gun of this type an operator, located upon a platform of the weapon, continuously replenishes the supply of ammunition in the ammunition container of the firing weapon during the weapon firing mode. To do so, the operator removes sets of cartridges from an upwardly located outlet opening of an upright reloading container and fills such into the ammunition container.

A drawback of this weapon system resides in the fact that for operating the same during firing of the weapon, there is required, apart from the gunner also an ammunition loader, or in the case of twin-guns even two ammunition loaders or loading operators for reloading the ammunition into the ammunition container. Furthermore, these loading operators must carry out their assignment unprotected against enemy fire.

SUMMARY OF THE INVENTION

Hence, with the foregoing in mind it is a primary object of the present invention to provide an improved construction of weapon system or firearm which is not associated with the aforementioned drawbacks and limitations of the prior art proposals.

Another and more specific object of the present invention aims at the provision of a new and improved construction of automatic gun wherein the ammunition need not be manually loaded from a reloading container into an ammunition container by loading personnel.

It is still another important object of the present invention to provide a novel construction of gun equipped with a reloading container incorporating means for automatically and reliably reloading ammunition from the reloading container into an ammunition container of the gun.

Now in order to implement these and still further objects of the invention, which become more readily apparent as the description proceeds, the weapon system of the present invention is manifested by the features that the reloading container is displaceably arranged at the gun mount and its ammunition outlet opening can be brought into alignment or registry with the ammunition inlet opening of the ammunition container which is rocked into its loading position. Further, the conveyor device or conveyor means comprises transport elements which together with the sets of cartridges can be moved out of the reloading container and displaced into the ammunition container.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

General Construction

Figure 1:
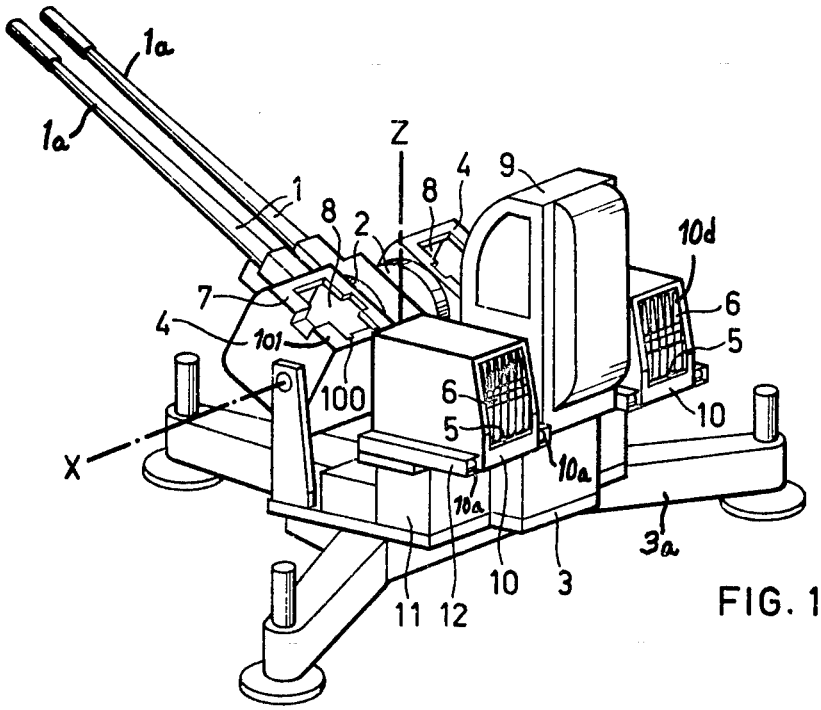
FIG. 1 is a perspective view of a weapon system or automatic gun constructed according to the present invention and containing an ammunition reloading container shown located in its rest or non-loading position.

Describing now the drawings, according to the showing of FIG. 1 the automatic weapon system or firearm will be seen to comprise two automatic guns or firing weapons 1. Each of these automatic guns 1 is pivotably mounted with its gun barrel 1*a* about an elevation laying or alignment axis X in a respective side plate or cheek 2. These side plates 2 are attached to a platform 3 which is rotatably mounted at a lower gun mount 3*a* for movement about a traverse or lateral aligning axis Z. At each gun 1 there is attached an ammunition container or magazine 4 at the side opposite the side plate 2. Each such ammunition container 4 is pivotably mounted together with the firing weapon 1 about the elevation laying or alignment axis X. Each of the ammunition containers 4 contain ammunition or cartridge clips 5 filled with a suitable type of ammunition i.e., cartridges 6. Such type ammunition container 6 has been disclosed in detail in the commonly assigned, U.S. Pat. No. 3,045,553, corresponding to Swiss Patent No. 379,969, to which reference may be readily had and the disclosure of which is incorporated herein by reference. The ammunition containers or magazines 4 comprise cover surfaces 7 which are substantially parallel to a plane containing the bore axes of the barrels 1*a* of the guns or firing weapons 1. Each cover surface 7 is provided with an opening 8 through which there can be filled the cartridge loading clips 5 together with the cartridges 6.

Behind each ammunition container 4 there is arranged an essentially prismatic or other suitably shaped reloading container 10 which is suited adjacent a cabin 9 for the gunner. Upon the platform 3 there are arranged the bases or supports 11 at which there are attached the guide rails or tracks 12 possessing a substantially U-shaped cross-sectional configuration. The reloading containers 10 are provided with rolls 10*a* at their side walls 65 and these rolls are guided in the guide rails or tracks 12, and thus, the reloading containers 10 can be shifted on the supports 11.

Figure 2:
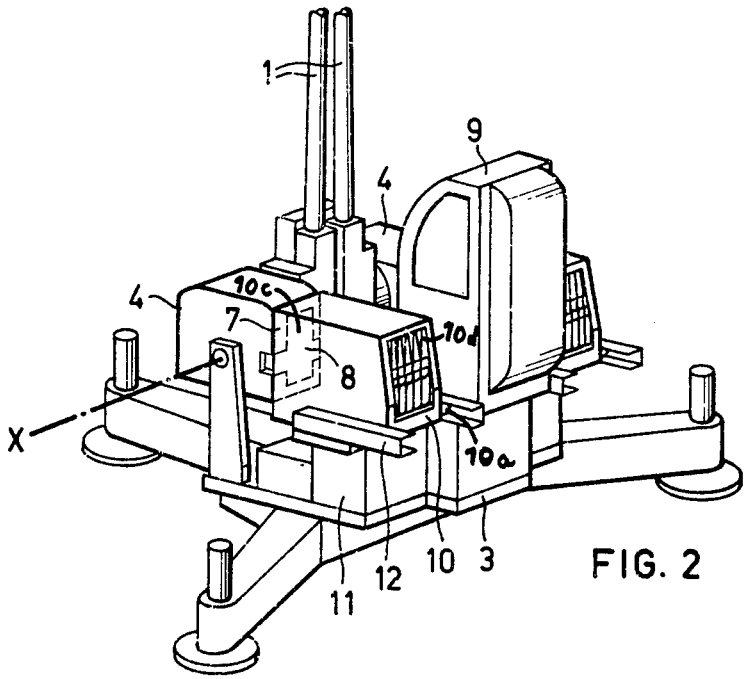
FIG. 2 is a perspective view of the same weapon system as in FIG. 1 but with the reloading container and ammunition container located in their ammunition reloading position.

According to the showing of FIG. 2, both of the automatic firing weapons or guns 1 can be rocked into the 90° elevational position, and then the cover surface or wall 7 of each such ammunition container 4 is also located essentially vertically and the associated reloading container 10 can be shifted upon the guide rails 12 to such an extent that the corresponding outlet or outfeed opening, generally indicated by reference character 10*c* of each such reloading container 10 aligningly bears at the inlet or infeed opening 8 of the cooperating ammunition container 4.

In the showing of FIGS. 1 and 2 the cartridge clips 5 together with their cartridges 6 are visible at the inlet or infeed openings 10*d* of the reloading containers 10.

Figure 3:
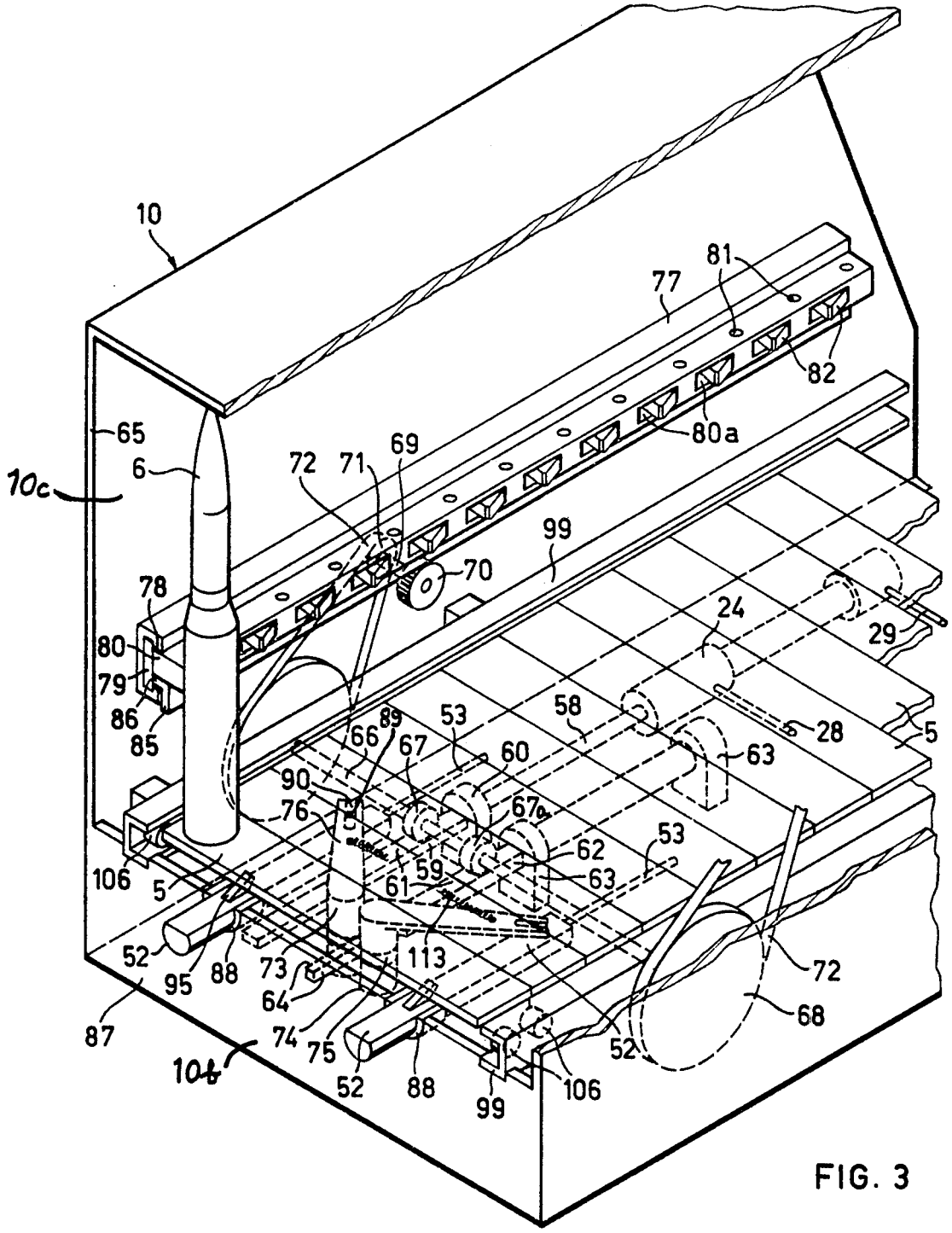
FIG. 3 is a perspective fragmentary cutaway view showing details of the reloading container.

According to the showing of FIG. 3 there are rotatably secured at the ends of the cartridge clips 5 two respective rolls or rollers 106. These rolls or rollers 106 are mounted in guide rails 99 possessing a substantially U-shaped cross-section and are attached to side or end walls 87 of the reloading container 10. Hence, the cartridge clips 5 are guided to be easily shiftable or displaceable in the reloading container 10.

These cartridge clips 5 with the cartridges 6 must be shifted out of the reloading container 10 into the related ammunition container or magazine 4. For this purpose there is provided a conveyor device, the details of which will be discussed more fully hereinafter. However, as soon as the ammunition container 4 is full, then a part of the cartridge clips 5 together with their cartridges 6 must again be pushed back or returned into the reloading container 10. For this purpose there is provided a retrieving or retracting device, which likewise will be considered more fully hereinafter.

In the description to follow there will be initially considered the construction of the conveyor device, thereafter the construction of the retrieving device and finally, also the hydraulic drive of both such devices.

CONSTRUCTION OF THE CONVEYOR DEVICE

Figure 4:
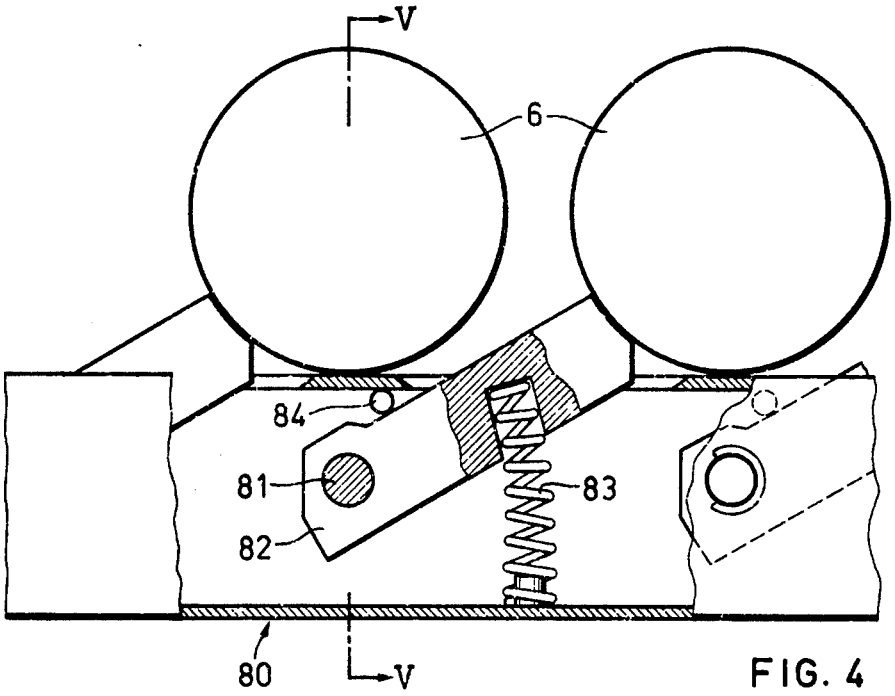
FIG. 4 is a longitudinal sectional view of a pawl holder of the reloading container.
Figure 5:
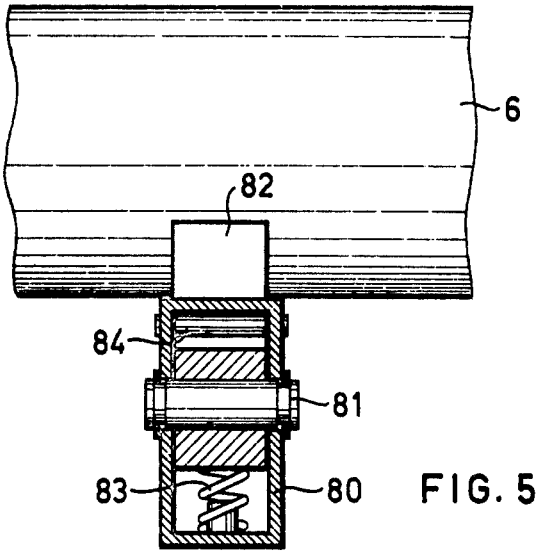
FIG. 5 is a cross-sectional view of FIG. 4, taken substantially along the line V—V thereof.

In order to displace the cartridge clips 5 out of the reloading container 10 into the associated ammunition container 4 there is attached at each side wall 65 a guide rail 77 having a substantially C-shaped cross-section. For the sake of clarity in illustration only one such guide rail 77 has been shown in FIG. 3. Each such guide rail 77 bears by means of its rear face or surface at the related side wall 65 of the reloading container 10. In each rail 77 there is displaceably mounted a carrier or support 79. At this carrier 79 there is attached a pawl holder 80 which, according to the showing of FIG. 5, possesses an essentially closed, rectangular hollow cross-sectional configuration and piercingly extends through a lengthwise extending slot 78 of the guide rail 77. At the pawl holder 80 there are attached the shafts 81 at a substantially uniform spacing from one another, as best seen by referring to FIG. 4. At these shafts or pins 81 there are pivotably mounted cartridge feed pawls 82 or equivalent structure. Springs 83, which bear at one end at the pawl holder 80 and at the other end at the feed pawls 82, strive to press the feed pawls 82 against stops 84 which are attached to the pawl holder 80. The feed pawls 82 extend through slots 80*a* out of the interior of the pawl holder 80. According to the showing of FIG. 3, there is fastened a gear rack 85 at the carrier or support 79, this gear or toothed rack 85 having a substantially L-shaped cross-sectional configuration. This gear rack 85 also bears at the pawl holder 80. The teeth of the gear rack 85 are downwardly directed and mesh with a spur gear 70.

In order to drive this spur gear 70 there is attached to the base or floor 10*b* of the reloading container 10 a hydraulic cylinder 24, or equivalent drive structure the axis of which is substantially parallel to a vertical symmetry plane of the reloading container 10. Within the cylinder 24 there is displaceably arranged a piston 25 which is not particularly shown in FIG. 3, but illustrated in FIG. 7, at which there is attached a piston rod 58 connected with a suitable gear rack 59. This gear rack 59 is guided in a bearing 60 attached to the floor 10*b* of the reloading container 10. The teeth 61 (FIG. 7) of the gear rack 59 are upwardly directed and mesh with a spur gear 67 which is keyed to a shaft 66 mounted at both oppositely situated side walls 65 of the reloading container 10. Upon this shaft 66 there are further attached two sprocket wheels or gears 68 which drive two sprocket wheels or gears 71 by means of the associated sprocket chain 72. Each of these sprocket wheels 71 is attached to a shaft 69, at the end of each of which there is keyed the aforementioned associated spur gear 70.

CONSTRUCTION OF THE RETURN OR RETRIEVING DEVICE

Fixedly keyed to the shaft 66 is a further spur gear 67*a* which meshes with a gear rack 62 mounted in the bearings 63. This gear rack 62 also possesses an upwardly directed array of teeth 61 and additionally two laterally disposed teeth means or teeth arrangements 64 located substantially symmetrically to both sides of the longitudinal central plane of the reloading container 10. The gear rack 62 is located in the vertical plane of symmetry of the reloading container 10. Arranged to both sides of the gear rack 62 are two hubs 73 which are directed perpendicular thereto, the hubs 73 being rotatably mounted at the sockets or pedestals 74. The sockets 74 are attached at the floor 10*b* of the reloading container 10. At the lower end of each of the hubs 74 there is attached a respective toothed segment 75 which meshes with the lateral teeth or teeth means 64 of the gear rack 62. At the upper end of each of the hubs 73 there is attached a respective lever 76. The toothed or rack segments 75 and hub 73 are located in parallel planes. In the drawings, a respective hub 73 is shown equipped with a respective lever 76 and a respective toothed segment 75. For the sake of clarity in illustration there also have been shown the other hub 73 with the second lever 76 and the other toothed segment 75. Both of the levers 76 are interconnected with one another by means of a tension spring 113 or equivalent structure.

Articulated to each lever 76 is a displaceable cylinder 52. The cylinders 52 are mounted in tubular pieces or elements 88, as best seen by referring to FIG. 3. These tubular elements 88 are attached at a front end wall 87. The end wall 87 possesses an outlet opening 10*c*, through which there can extend the cartridges 6 from the reloading container 10 into the ammunition container 4. The tubular elements 88 extend rearwardly into the reloading container 10 and are arranged symmetrically with respect to the longitudinal central plane. The cylinders 52 which are displaceable in the related tubular element 88 each possess a downwardly directed vertical bolt 89. Each bolt 89 engages into a slot 90 of the associated lever 76, as particularly well seen by referring to FIGS. 3 and 6.

Figure 6:
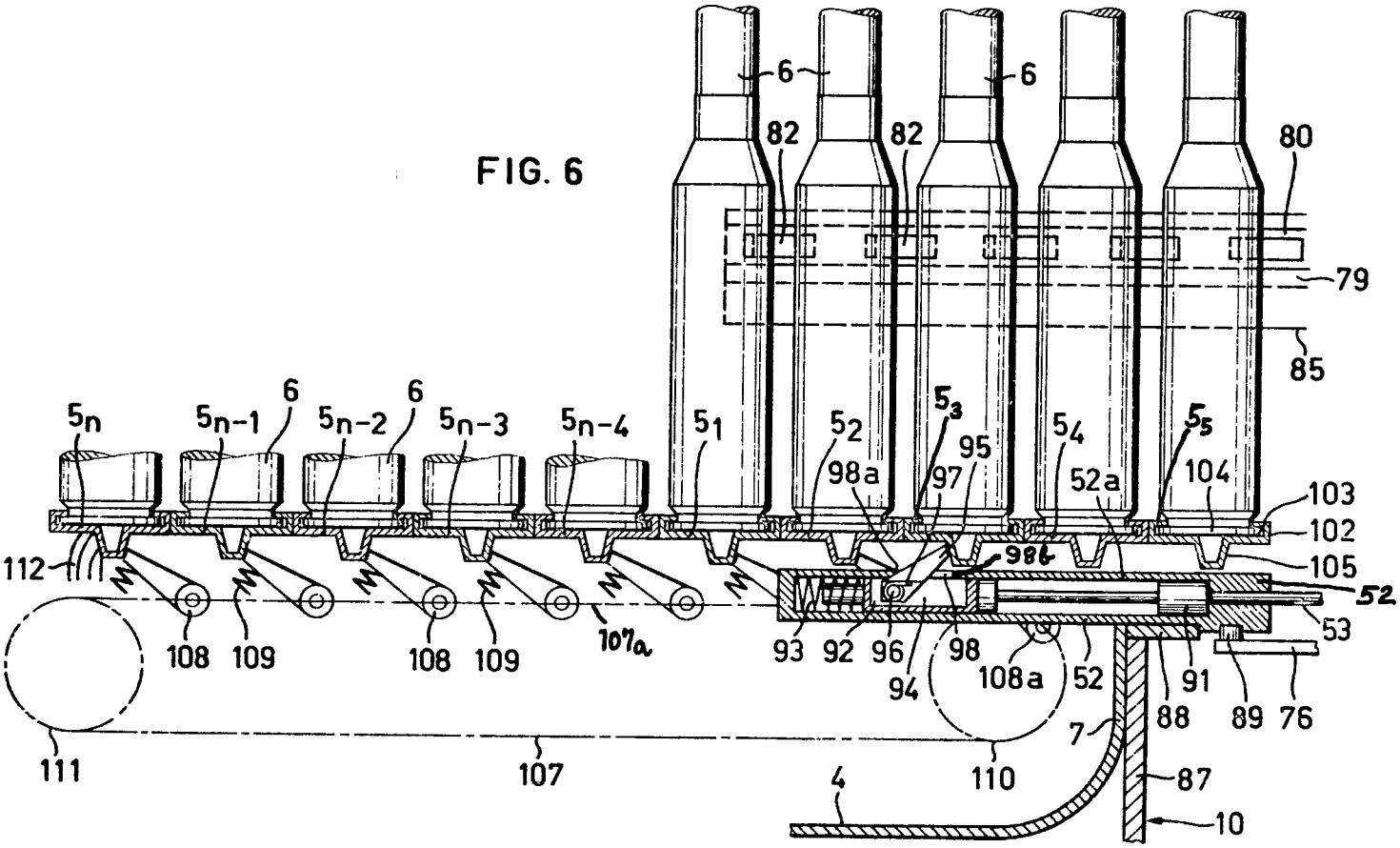
FIG. 6 is a cross-sectional view through a pawl holder of a retrieving device for cartridge clips containing the cartridges or ammunition, the pawl holder being shown in its extended position.

As best seen by referring to FIG. 6, a piston 91 is located at the rear portion of each cylinder 52. The piston 91 pushes against a substantially cylindrical carriage 92, which likewise is displaceably arranged in this cylinder 52. Two springs 93 or equivalent structure, which bear at one end at the cylinder 52 and at the other end at the carriage 92, strive to press the carriage 92 towards the piston 91. Machined in the carriage 92 is a groove 94 in which there is pivotably mounted a pawl 95 about a shaft or pivot journal 96. A spring 97, bearing at one end at the base of the groove 94 and at the other end at the pawl 95, strives to rotate the pawl 95 in clockwise direction. Under the action of the spring 97 the pawl 95 extends through a slot 98 of the cylinder wall **98*b* towards the rear and bears against a stop or impact member 98*a* which is formed by the front boundary or boundary wall of the slot 98**.

As further seen by referring further to FIG. 6 the cartridge clips 5 each possess a rib 105 of substantially U-shaped cross-sectional configuration. Each such rib 105 extends substantially over the entire length of the related cartridge clip 5. The pawl 95 impacts against such rib 105 when it is located in the just-described position. By means of this pawl 95 the cartridge clips designated by reference character $5_3$ and $5_4$, which are already located in the ammunition container or magazine 4, as shown in FIG. 6, can be again pushed back again into the reloading container 10.

CONSTRUCTION OF THE AMMUNITION CONTAINER

Exactly as was the case for the reloading container 10 guide rails 100 (FIG. 1) are also attached to the ammunition container 4 at both end walls 101. When both of the containers 4 and 10 are located in the loading position shown in FIG. 2, then the guide rails 99 of the reloading container 10 are in registry or alignment with the guide rails 100 of the ammunition container 4 in such a manner that the cartridge clips 5 together with their rolls or rollers 106 can easily move out of the guide rails 99 of the reloading container 10 into the guide rails 100 of the ammunition container 4.

Arranged in the ammunition container 4 is an endless conveyor chain 107 or equivalent structure, which is guided over a deflection wheel 110 and a drive wheel 111. Transport or feed pawls 108 are hingedly connected or articulated to this conveyor chain 107. Springs 109 or equivalent structure, bearing at one end at the conveyor chain 107 and at the other end at the transport pawls 108, strive to rock the transport pawls 108 into their cartridge clip-entrainment position. The spacing between the individual transport pawls 108 at the conveyor chain 107 corresponds to the width of the cartridge clips 5. The conveyor chain 107 is located in the longitudinal central plane of the ammunition container 4. This longitudinal central plane of the ammunition container 4 is disposed at right angles to the elevation axis X and coincides with the longitudinal central plane of the reloading container 10.

At the region of the drive wheel or gear 111 there are arranged the transport worms 112, by means of which there are further displaced the cartridge clips 5 during and after the removal of the cartridges 6. According to the showing of FIG. 6 the cartridge clip $5_n$ bears against the transport worms 112. The cartridges 6 are stripped out of such clip $5_n$ in order to supply the associated firing weapon or gun 1. At the same time this cartridge clip $5_n$ together with the following cartridge clips $5_{n-1}$, $5_{n-2}$, $5_{n-3}$, $5_{n-4}$, are forwardly shifted by means of the conveyor chain 107. During the removal of the cartridges 6 out of the rearmost cartridge clip $5_n$ this cartridge clip $5_n$ moves towards the rear, and thus, the spacing of the forwardmost cartridge clip $5_2$, engaged by a transport pawl 108 of the conveyor chain 107, from the container wall 7 is dependent upon the number of cartridges which are still located in the rearmost cartridge clip $5_n$.

CONSTRUCTION OF THE HYDRAULIC DRIVE

Figure 7:
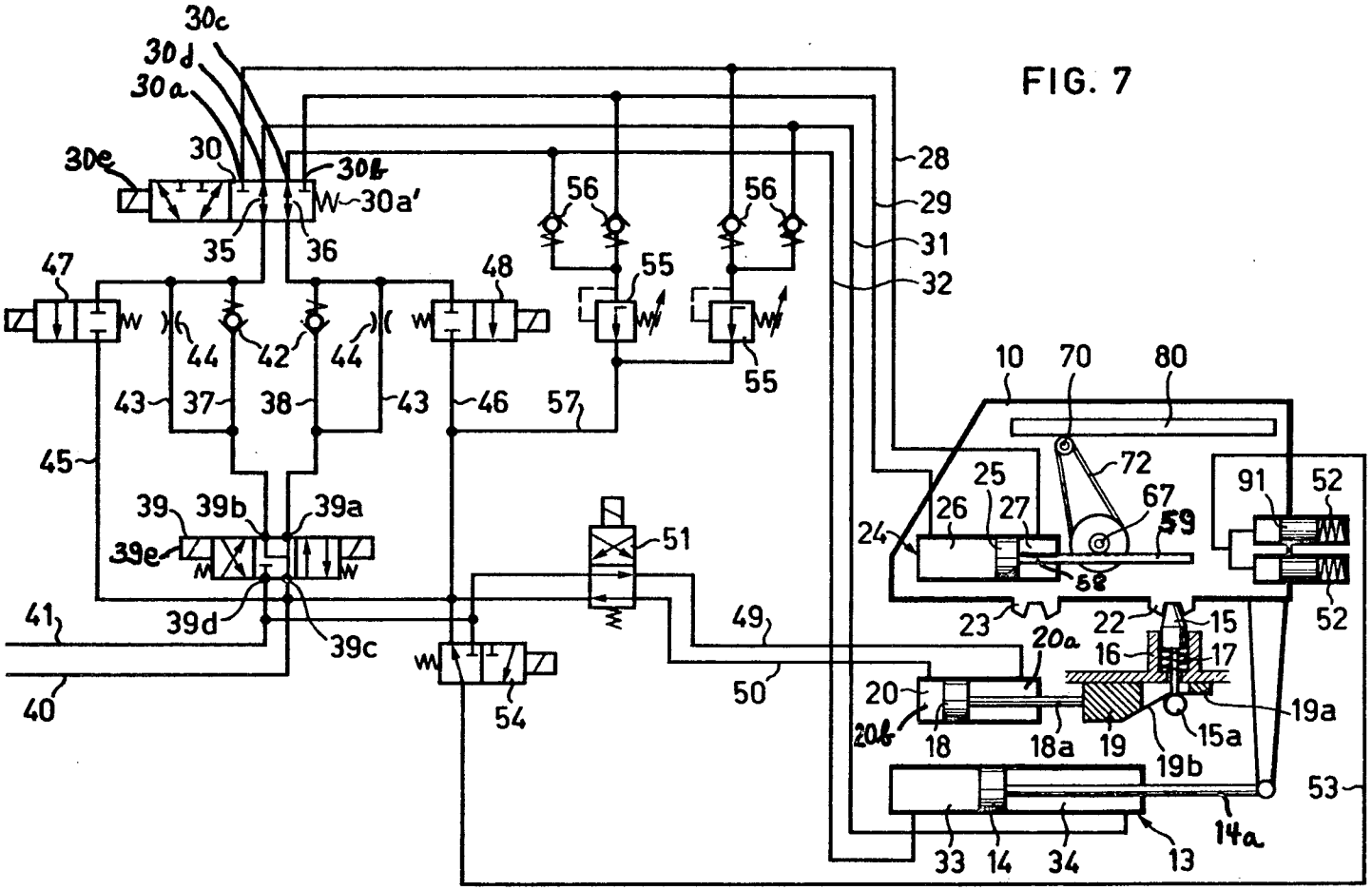
FIG. 7 is a schematic circuit diagram of the hydraulic system or installation by means of which the ammunition can be loaded from the reloading container into the ammunition container.

According to the showing of FIG. 7, a cylinder 13 is secured to the base 11 in order to displace the associated reloading container 10 along the guide rails 12. A piston 14 is reciprocably arranged within the cylinder 13. This piston 14 is connected by means of a piston rod **14*a* with the reloading container 10. In order to fix the reloading container 10 in its terminal or end positions a conically tapering bolt 15 or equivalent latching structure is vertically displaceably mounted in a guide 16 attached at the support or base 11. A pressure or compression spring 17, which bears at one end at the guide 16 and at the other end at the latching bolt 15, strives to force the bolt 15 into one or two locking means or latching notches 22 and 23. These locking means or latching notches 22, 23 or equivalent structure are arranged behind one another in the direction of movement of the reloading container 10 at the latter. A roll or roller 15*a* is rotatably mounted at the bolt 15, roller 15*a* bearing against a slide or cam surface 19. This slide 19 or equivalent structure is operatively connected by means of a piston rod 18*a* with a piston 18 which reciprocally arranged in a cylinder 20. Cylinder 20 is conveniently attached to the base or support 11**.

Depending upon the position of the piston 18 and the slide 19 the roller or follower element **15*a* is either located in contact with the slide surface 19*a* which extends substantially parallel to the floor 10*b* of the reloading container 10 and the bolt 15 protrudes into one or the other of the locking or latching means 22 and 23, or else is in contact with the camming surface 19*b* which is inclined with respect to such floor 10*b* of the reloading container 10 and hence the locking or latching bolt 15 is retracted from the locking means 22 and 23**.

The previously described cylinder 24 is subdivided by the piston 25 into two chambers or compartments 26 and 27. Both of these chambers 26 and 27 are connected by means of the conduits or lines 28 and 29 respectively, with two connections or ports **30*a* and 30*b* of a reversing valve 30. Furthermore, both of the chambers 13 and 14 of the cylinder 13 are also connected by means of the conduits or lines 31 and 32 with the connections or ports 30*c* and 30*d* of this valve 30. The valve 30 is, in turn, connected through the agency of the conduits or lines 37 and 38 at two connections or ports 39*a* and 39*b*, respectively, of a reversing valve 39. Both of the connections 39*a* and 39*b* are connected with a third connection or port 39*c* of the reversing valve 39. Leading from the third connection 39*c* is a return flow line or conduit 40 to a not particularly illustrated fluid e.g. oil container or reservoir. A fourth connection or port 39*d* of the reversing valve 39 is connected with a supply conduit or line 41 which is operatively coupled with a not particularly illustrated fluid supply pump. Check or non-return valves 42 are installed in the conduits 37 and 38, these check valves 42 preventing return flow of the liquid from the reversing valve 30 to the reversing valve 39. The check valves 42 are bypassed or bridged by the conduits or lines 43 at which there are arranged the throttles 44. Both of the conduits or lines 37 and 38 are connected by means of further conduits or lines 45 and 46 with the return flow line 40. Shut-off valves 47 and 48 are mounted in both of these conduits or lines 45 and 46** respectively.

Both of the chambers 20*a* and 20*b* of the cylinder 20 are connected by means of the conduits or lines 49 and 50 with a reversing valve 51. This reversing valve 51 is connected both with the supply line or conduit 41 as well as also with the return flow line 40. The aforementioned cylinders 52 are connected by a single conduit 53 with a reversing valve 54, which likewise is flow connected with the supply line 41 and with the return flow line 40. By means of two pressure limiting valves 55 the conduits or lines 28, 29, 31 and 32 are protected against exposure to too great pressures. Both of the pressure limiting valves 55 are connected by means of four check or non-return valves 56 with the aforementioned four conduits or lines 28, 29, 31 and 32 and by means of a conduit or line 57 with the return flow line 40.

OPERATION

Having now had the benefit of the foregoing discussion of the apparatus its mode of operation will be considered and is as follows: At this point it is remarked that since the operation is the same for both guns, it will be sufficient to generally describe the system operation in connection with any one such gun and its associated structure. As long as both automatic firing weapons or guns 1 are not elevated through 90°, then both of their reloading containers 10 are located in their rear starting position corresponding to the showing of FIG. 1. All parts of the cartridge conveyor or conveying device and the return or retrieving device are located in the positions illustrated in FIGS. 3 and 7. The cartridge clips 5 which are filled with the cartridges 6 are pushed from the rear through the filling or infeed opening 10*d* into the associated reloading container 10, and the rollers 106 of the cartridge clips 5 come into riding contact with the guide rails 99. The forwardmost one of such inserted cartridge clips $5_1$ impacts by means of its rib 105 against both of the pawls 95 of the cylinders 52, which are located in their rearmost position as shown in FIG. 3. The subsequent or trailing cartridge clips $5_2$, $5_3$ . . . mutually contact one another. Both of the outermost or outboard cartridges 6 of each cartridge clip 5 bear against the pawls 82 and at the pawl holder 80. During forward feed of the cartridge clips 5 the spring-loaded pawls 82 which protrude out of the pawl holder 80 are pushed against the force of the springs 83 into the interior of the pawl holder 80. As soon as the cartridge 6 has been displaced past the pawl 82, then this pawl 82 is again rocked back by the springs 83 into its starting position. The cartridges 6 are then engaged at the rear by the pawls 82, as best seen by referring to FIG. 4, and thus these cartridges 6 together with the cartridge clips 5 are secured against any undesired rearward sliding movement.

In order to reload the magazine container 4 the firing weapons or guns 1 are rocked into the 90° elevation position, as shown in FIG. 2. In this position the cover surfaces or end wall 7 of the ammunition or magazine containers 4 are disposed substantially parallel to the front walls 87 of the reloading containers 10. Now the reloading containers 10 are moved forwardly. By switching-on the valve 47 the chamber of compartment 34 of the cylinder 13 is connected with the return flow line 40. At the same time the valve 39 is shifted towards the right (considered with respect to the showing of FIG. 7) and the cylinder chamber 33 is flow-connected by means of the conduits or lines 38, 32 with the fluid supply line 41. By reversing or switching the reversing valve 51 the piston 18 is now loaded such that the piston rod 18*a* shifts the slide 19 towards the right. The roller or follower element 15*a* travels upon the inclined cam surface 19*b* provided at the slide or cam 19 and thereby retracts the latching bolt 15 out of the locking means or latching notch 22. The corresponding reloading container 10 is forwardly driven by the piston rod 14*a*. Shortly before it impacts against the cover surface 7 of the associated magazine or ammunition container 4, the valves 47 and 51 are again returned into the position shown in FIG. 7. After the reloading container 10 has moved through a predetermined displacement path, the valve 51 is reversed and the piston 18 together with its piston rod 18*a* returns into its starting position. Due to this movement the slide 19 is displaced toward the left, and the roller 15*a* together with the latching bolt 15 is urged upwardly by means of the spring 17. When the reloading container 10 has contacted the cover surface 7 of the magazine or ammunition container 4, then the latching bolt 15 slides into the locking or latching means 23 of the reloading container 10 and locks the same against any further unintentional displacement. Controlled by such locking action the valve 39 returns back into its starting position as shown in FIG. 7, so that the piston 14 now can no longer be driven. Merging with the rails 99 of the reloading container 10 are the aligned rails 100 of the magazine or ammunition container 4.

For the further discussion of the reloading operation it is at this point assumed that there are still located five cartridge clips $5_n$, $5_{n-1}$, $5_{n-2}$, $5_{n-3}$, $5_{n-4}$ in the magazine or ammunition container 4 which has a receiving or fill capacity for seven cartridge clips 5, and thus two cartridge clips are to be loaded from the reloading container 10 into the magazine or ammunition container 4. The ribs 105 of the cartridge clips 5 located in the magazine container 4 are engaged therebehind by the pawls 108 of the stationary conveyor chain 107. In order to drive the pawl holder 80 the valves 30, 39 and 48 are switched-on.

At the valve 39 the control piston 39*e* is now displaced towards the left. Consequently, the cylinder chambers 27 and 26 are connected with the supply line 41 and with the return flow line 40, respectively, and the piston 25 moves the gear rack 59 in the reloading container 10 towards the rear. At the same time, by switching-on the valve 54, the cylinders 52 are connected with the supply line 41, so that the pistons 91 forwardly displace the carriages 92, and, as a result thereof, the pawls 95 are rocked by the impact or contact surfaces 98*a* out of the path of the ribs 105 of the cartridge clips 5 into the grooves 94.

The spur gear 67 which rolls upon the gear rack 59 drives the shaft 66, and the gear 67*a* driven thereby moves the gear rack 62 towards the rear. Upon initiation of the rearward movement of the gear rack 62 its lateral teeth 64 mesh with the tooth or toothed segments 75, so that both levers 76 are rocked about their axes in opposite rotational directions. Consequently, the cylinder 52 is moved forwardly into the interior of openings, not particularly shown in the drawing, which have been bored in the cover surface 7 of the associated ammunition or magazine container 4. During the pivoting of the lever 76 the spring 113 is moved in front of its axis of rotation, so that it retains the lever in a position where the cylinder 52 bears at the guide tubes 88 in the wall 87. The transmission ratio of the drive for the cylinder 52 is selected such that such moves with the same speed or velocity as the pawl holder 80.

The sprocket gears or wheels 68 driven by the shaft 66 drive through the agency of the chains 72 or equivalent structure the pairs of sprocket gears or wheels 71, 70 so that the gears 70 meshing with the gear racks 85 forwardly move the pawl holders 80. Consequently, all of the cartridge clips 5 located in the reloading or loading container 10 are pushed forwardly by the pawls 82 which engage with the outermost cartridges 6 at the height of their center of gravity. The cartridge clips $5_1$, $5_2$, $5_3$, $5_4$ enter the magazine container 4 together with the pawl holders 80, and their rollers 106 are guided in the guide rails thereof. When both of the forwardmost cartridge clips $5_1$, $5_2$ move against the clips 5 stacked in the ammunition or magazine container 4, then their ribs 105 momentarily downwardly press both of the uppermost pawls 108 located at the upper run 107*a* of the conveyor chain 107, whereupon such pawls then engage behind the ribs 105 for the purpose of moving the clips towards the transport worm 112.

After both of the cartridge clips $5_1$, $5_2$ have moved forwardly to a location where they are adjacent the cartridges contained in the ammunition or magazine container 4, then there is initiated a change in the direction of movement of the piston 25 and the gear rack 59 by any suitable and therefore not particularly illustrated means. The change in direction of movement occurs by shifting the control piston 39*a* of the valve 39 towards the right (viewed with respect to FIG. 7), and by switching-on the valve 47. At the same time the cylinders 52 are connected with the return flow line 40 by returning the valve 54 into the operating position shown in FIG. 7. Under the pressure of the springs 93 the carriages 92 together with the pistons 91 now move rearwardly, and the oil is displaced out of the piston chambers i.e., the cylinders 52. During the movement of the carriages 92 the pawls 95 are released for tilting into the blocking position where they are located in front of the rib 105 of the cartridge clip $5_3$ which has been conveyed by the pawl holder 80 into the magazine container 4, which cartridge clip has not yet been engaged by the feed pawl 108*a* of the transport or conveyor chain 107.

With the now occurring rearward movement of the cartridge transport pawl holder 80 the back portions or spines 82*a* of the transport or feed pawls 82 travel against the outermost cartridges 6 of the cartridge clips 5, so that they are moved back into the pawl holders, and after passing the cartridges 6, which remain at rest due to their moment of inertia, are moved back again into their rest position under the pressure of the springs 83. Shortly before the gear rack 62, which is moved forward simultaneous with the gear rack 59, has reached its forward terminal or end position, its lateral teeth 64 come into engagement with the tooth segments 75. As a result, the levers 76 are rotated back and the cylinders 52 are moved back with the same speed as the pawl holders 80 which are already in motion. The pawls 95 now push the package of cartridge clips 5, reduced by two units, back into the reloading container 10. At the end of the movement of the gear racks 59, 62 and 85 the pawl holders 80 and the cylinders 52 are again located in their rest position as shown in FIG. 3, and the ribs 105 of the now forwardmost charging clip $5_3$ bears against the pawls 95.

Before the reloading container 10 has been moved back into its starting position, the latching bolt 15 is withdrawn out of the locking means or arresting or latching notch 23 by switching-on the valve 51. After switching-off the valve 30 its control piston 30*e* is returned by the spring 30*a'* back into the position shown in FIG. 7, and further, the control piston 39*e* of the valve 39 is displaced towards the left. The chamber 34 of the cylinder 13 is now connected with the supply line 41, and the chamber 33 is connected by means of the switched-on valve 48 with the return flow line 40, so that the reloading container 10 is moved rearwardly away from the ammunition or magazine container 4. After switching-off the valve 51 the latching bolt 15 is released. When the reloading container 10 has reached its rear starting position, then the bolt 15 engages with the locking or latching means 22, and the valve 39 assumes the operational position shown in FIG. 7. Hence, the reloading container 10 is again fixed in place. The firing weapons or twin guns 1 together with the ammunition or magazine containers 4 can now be rocked back or layed into an elevational position which is less than 90°.

While there are shown and described present preferred embodiments of the invention, it is to be distinctly understood that the invention is not limited thereto, but may be otherwise variously embodied and practiced within the scope of the following claims. Accordingly,

What we claim is:

1. A weapon system comprising:

a gun mount;

an automatic gun arranged at said gun mount;

an ammunition container provided for said automatic gun;

means for supporting said automatic gun together with said ammunition container to be pivotable about an elevation alignment axis;

a reloading container for cartridges, said reloading container having an outlet opening and being arranged at said gun mount;

a conveyor device provided for the reloading container for forwardly displacing sets of cartridges located in the reloading container to said outlet opening, from which location the cartridges can be filled into the ammunition container;

said ammunition container having an inlet opening for receiving the cartridges from the reloading container;

said supporting means mounting said ammunition container to be pivotable into a cartridge loading position;

means for displaceably mounting the reloading container at the gun mount in order to bring the outlet opening thereof into alignment with the inlet opening of the ammunition container when pivoted into its loading position; and said conveyor device comprising transport elements which can be shifted together with the sets of cartridges out of the reloading container at least partially into the ammunition container.

2. The weapon system as defined in claim 1, wherein:

said reloading container is displaceably mounted at said gun mount to be displaceable between two terminal positions;

a first hydraulic drive for displacing the reloading container and for fixing the same in each of its two terminal positions;

a second hydraulic drive cooperating with said conveyor device for forwardly displacing the entire supply of cartridges from the reloading container into the ammunition container; and a third hydraulic drive for retrieving the remainder of the cartridge supply which does not have place in the ammunition container.

3. The weapon system as defined in claim 2, wherein:

said third hydraulic drive encompasses a retrieving mechanism for said retrieving of the portion of the cartridge supply which does not have place in the ammunition container;

said retrieving mechanism including pawls;

said third hydraulic drive comprising a first means for engaging and disengaging said pawls and a second means for the forward and reverse shifting of said pawls.

4. The weapon system as defined in claim 2, wherein:

said conveyor device for forwardly displacing the sets of cartridges comprises two pawl holders;

said reloading container having two side walls;

a respective cartridge clip for holding each set of cartridges in a row;

said two pawl holders being displaceably mounted at said two side walls;

a pawl provided for each pawl holder for each row of cartridges located in a cartridge clip for simultaneously displacing the entire supply of cartridges;

said pawl holders and pawls defining said transport elements.

5. A weapon system comprising:

a gun mount;

at least one automatic gun support at said gun mount;

an ammunition container provided for said automatic gun;

means mounting said automatic gun together with said ammunition container to be pivotable about an elevation aligning axis into a cartridge loading position;

a reloading container for cartridges and having an outlet opening and arranged at said gun mount;

conveyor means provided for the reloading container for bringing predetermined ones of said cartridges located in the reloading container to said outlet opening, from which location the cartridge can be filled into the ammunition container;

said ammunition container having an inlet opening for receiving the cartridges from the reloading container;

means for displaceably mounting the reloading container in order to bring the outlet opening thereof into cartridge transfer registry with the inlet opening of the ammunition container when pivoted into its loading position; and said conveyor means comprising mechanism which can be shifted together with the cartridges out of the reloading container at least partially into the ammunition container.

* * * * *